United States Patent [19]

Feld et al.

[11] Patent Number: 4,901,290

[45] Date of Patent: Feb. 13, 1990

[54] APPARATUS FOR THE GENERATION OF PRESSURE PULSES IN DRILLING MUD COMPOSITIONS

[75] Inventors: Dagobert Feld, Hanover; Johann Biehl, Kirchheim/Teck, both of Fed. Rep. of Germany

[73] Assignee: Eastman Christensen Company, Salt Lake City, Utah

[21] Appl. No.: 191,409

[22] Filed: May 9, 1988

[30] Foreign Application Priority Data

May 9, 1987 [DE] Fed. Rep. of Germany ..... 37155148

[51] Int. Cl.[4] ..... G01V 1/40

[52] U.S. Cl. ..... 367/85

[58] Field of Search ..... 367/83, 84, 85; 175/40; 33/306; 251/35, 30.02, 30.05; 137/624.13

[56] References Cited

U.S. PATENT DOCUMENTS

| | | | |
|---|---|---|---|
| 4,386,422 | 5/1983 | Mumby et al. | 367/85 |
| 4,499,563 | 2/1985 | Jurgens | 367/84 |
| 4,703,461 | 10/1987 | Kotlyar | 367/83 |
| 4,742,498 | 5/1988 | Barron | 367/85 |

*Primary Examiner*—Thomas H. Tarcza
*Assistant Examiner*—Ian J. Lobo
*Attorney, Agent, or Firm*—Joseph A. Walkowski

[57] ABSTRACT

The apparatus for the generation of pressure pulses in a drilling mud composition which flows downward in a drill string (1) is composed of a valve (V) inside the drill string (1), with a stationary, braced, tubular exterior housing (3), tubular primary valve (4) which can be translated from a lower starting position against the flow direction (2) of the drilling mud composition into an upper operational end position, a stationary, tubular support (5) in a coaxial position inside primary valve (4), and a pilot valve (13), (14) actuated by motor means (15). Exterior housing (3) and primary valve (4) define a constricted segment (29) whose flow cross section can be modified by the position of primary valve (4), and primary valve (4) and the support (5) surround an interior flow channel (21), (12) and (10), which can be opened and closed by outlet orifice (13) of pilot valve (13), (14). The sum of the downward fluid forces and the gravitational forces in the drilling mud composition acting on the primary valve in its starting position when pilot valve (13), (14) is open exceeds the upward fluid forces, and these force relations can be reversed by closing auxiliary valve (13), (14). In the fluid operational end position of primary valve (4), the sum of all forces acting on primary valve (4) is equal to zero, and primary valve (4) is suspended in the drilling mud composition without contacting stop (34) thereabove.

11 Claims, 4 Drawing Sheets

APPARATUS FOR THE GENERATION OF PRESSURE PULSES IN DRILLING MUD COMPOSITIONS

BACKGROUND OF THE INVENTION

The invention relates to an apparatus for the generation of pressure pulses in a drilling mud composition which flows downward in a drill string.

According to a known apparatus of this type (U.S. Pat. No. 3,958,217), the exterior part of the valve assembly forms a valve seat, which limits the upward motion of the primary valve in the final operational position acting as a stp, and which, with engagement of the primary valve, blocks the central flow passage for the drilling mud composition. The valve seat acting as a stop determines the final position of the primary valve. The sum of the downward hydraulic forces which are exerted on the primary valve in its starting position, when the pilot valve for the drilling mud composition is open, exceeds the sum of the upward hydraulic forces, with the result that the primary valve is immobilized in its starting position when the pilot valve is open. When the pilot valve is closed, the pressure differential is reversed, resulting in the upward motion of the primary valve until it reaches its final position as determined by the valve seat.

SUMMARY OF THE INVENTION

The invention is based on the problem of creating an apparatus of the type described above, which has a valve with simple construction design, which operates without percussive effects, avoids mechanical abrasion and remains perfectly operational even after a longer operation period without maintenance.

In a preferred embodiment of an apparatus according to the invention, the primary valve reaches a final operational position solely as a result of an equilibrium of fluid forces acting on it, thus avoiding percussive effects resulting from the impact of the primary valve with a stop which defines the final operational position in the pressure pulse generation, and without a stop to achieve the final operational position. When percussive effects are avoided, abrasion and damage are avoided at the same time. Since, with the exception of the forces of gravity, the final operational position of the primary valve is exclusively due to the fluid forces of the drilling mud composition acting on the primary valve, it is possible to select for the primary valve, the configuration of which determines the upward motion of the primary valve, an acceleration pathway with respect to the rate of change of velocity over the pulse height which does not require any of the precautions which have to be considered if the final operational position is predetermined by a stop because of an abrupt braking of the primary valve due to collision with the stop. It is possible to implement the apparatus according to a very simple construction design which allows proper functioning even after prolonged use without maintenance.

BRIEF DESCRIPTION OF THE DRAWINGS

Further details and advantages are contained in the description and the drawings which illustrate schematically one execution example of the object of the invention. The drawings consist of.

DETAILED DESCRIPTION OF A PREFERRED EMBODIMENT

Figure 1:
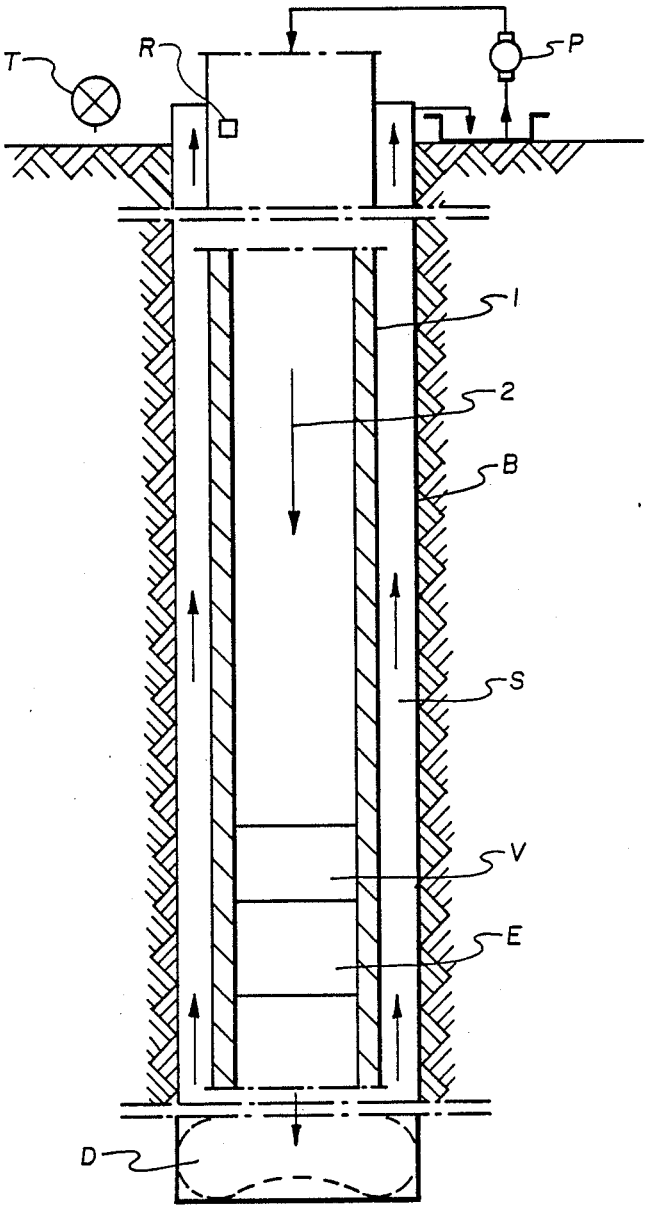
FIG. 1, a simplified partial cross section of a drill string in the wellbore of a deep drill hole.

The apparatus generates pressure pulses in a drilling mud composition which moves downward in the direction of arrow (2) in a drill string and which flows upward, after flowing through a bit (D) at the tip of drill string (1) into the wellbore (B), in the annular space (S) between its wall and the exterior wall of the drill string. The apparatus consists essentially of a valve (V) positioned in drill string (1), which valve consists of an exterior housing (3), a primary valve (4) and a support (5).

The apparatus for the generation of pressure pulses is part of an apparatus for the determination and teletransmission of data (E), or it operates in conjunction with such an apparatus, which is also positioned in drill string (1), in general, immediately below valve (V).

The pressure pulses, which are generated by valve (V) in the drilling mud composition which is pumped downward by pump (P), are received by pressure sensor (R) and are transmitted from the sensor to processing unit (T), in which the signals received are evaluated.

The stationary, essentially tubular exterior housing (3), is secured within drill string (1) and consists of an upper collar section (6) with a central axial flow orifice (7), the cross section of which is significantly less than the unrestricted cross section of drill string (1) above valve (V). Furthermore, the bottom of stationary exterior housing (3) is braced by bottom flange (8) of support (5), which has a closed construction in its central section (9), with the exception of an axial flow orifice (10). However, between area (9) and the interior of exterior housing (3) there remain drilling mud composition flow orifices (11'), distributed about the circumference of bottom flange (8), to accommodate a downward flow of drilling mud through an annular exterior flow channel (11) between exterior section (3) and primary valve (4).

Bottom flange (8) is either a separate part or an integral part of support (5), whose construction is essentially tubular with a central flow orifice (12) in its upper section in communication with the flow orifice (10) of bottom flange (9). A valve seat (13) in the lower section of flow orifice (10) serves simultaneously as the outlet orifice of an interior flow channel, which is delineated at its lower section by axial flow orifices (12) and (10).

Figure 2:
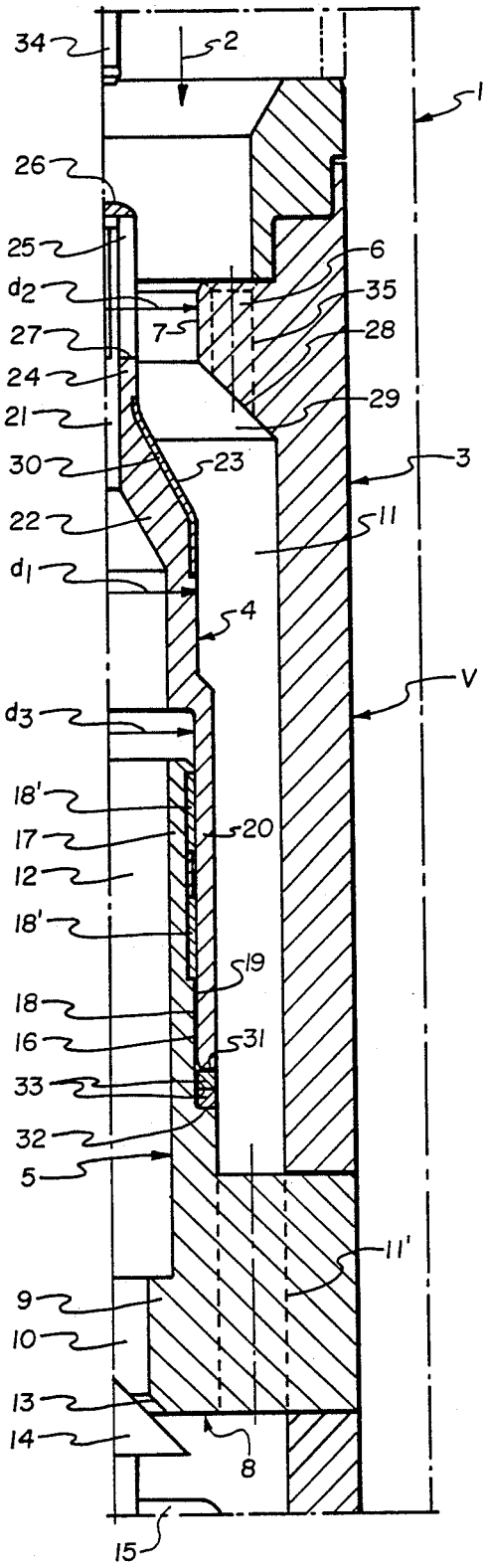
FIG. 2, a partial cross section of a pressure pulse generating apparatus according to the invention in a drill string according to FIG. 1, with the primary valve in the starting position.
Figure 3:
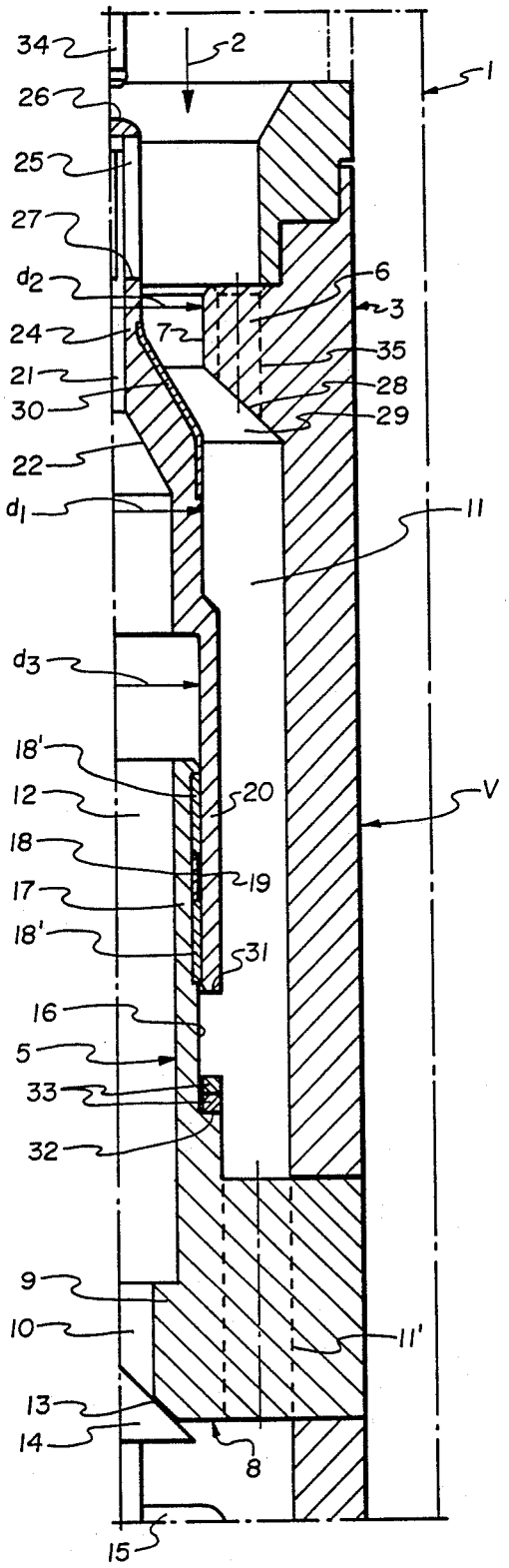
FIG. 3, a representation corresponding to FIG. 2 with the primary valve in the final operational position.

The valve sea (13) associated with the outlet orifice cooperates with a pilot valve body (14), which may be moved by a motor means, indicated schematically at (15), for example, an electromagnet, from the open position shown in FIG. 2 to the closed position shown in FIG. 3, so that it closes the outlet orifice.

The configuration of support (5) in the area of exterior surface (16) of its upper section (17) is essentially cylindrical, and it forms with this exterior surface (16) the inside wall of a ring shaped bleed slit (18), which on its exterior is limited by an essentially cylindrical interior surface (19) of tubular contact piece (20) of primary valve (4). The starting position of primary valve (4) shown in FIG. 2 with the entire length of opposite surfaces (16) and (19) defines an area of overlap between primary valve (4) and support (5), whose length decreases as soon as primary valve (4) is set in upward motion.

The cylindrical (or annular) bleed slit (18) between primary valve (4) and support (5) gives free access to the drilling mud composition which flows as a result of a pressure gradient between the drilling mud in flow orifice (12) and in exterior flow channel (11). Thus, bleed slit (18) can form, either over the whole length, or, as represented, in consecutively arranged partial sections (18'), a constricted path in which the slit width is less than one-hundredth of the diameter of the ring shaped bleed slit (18), preferably in the range of 0.05–0.5 mm, more preferably 0.15 mm.

The uppermost section (22) of primary valve (4) is closed with the exception of axial flow orifice (21), and in the illustrated example it has a conical transition area (23) on its exterior which narrows at the top to probe (24). Lateral flow orifices (25) in probe (24) communicate with flow orifice (21). Probe (24) is closed at its upper end (26), and in the starting position of the primary valve (FIG. 2) it is in a position in which the lower edge (27) of lateral orifices (25) is located within cylindrical flow orifice (7) in ring section (6) of exterior housing (3). These lateral orifices (25) form the inlet orifices for an interior flow channel whose upper section is defined by flow orifice (21) and which is continued by the flow orifices (10) and (12). Probe 24 forms a kind of Pitot tube with an essentially constant diameter over its entire length.

In transition area (23) of primary valve (4) the exterior diameter increases gradually as the axial distance from upper end (26) of primary valve (4) increases, finally reaching diameter ($d_1$), which in the illustrated example has approximately the same magnitude as diameter ($d_2$) of axial flow orifice (7) which forms a cylindrical constriction. Furthermore, diameter ($d_1$) is essentially equal to diameter ($d_3$) of interior surface (19) of contact piece (20) of primary valve (4). Further details concerning the diameter and its determination respectively ar provided below.

Collar section (6) of exterior housing (3) also has a transition area (28) whose diameter increases gradually as the axial separation from the upper end of exterior housing (3) increases. In the illustrated example it takes the form of a conical widening.

Instead of the represented increase of diameters of transition areas (23) and (28) which is linear with respect to each respective axial separation distance, it is also possible to configure the increase in diameter with increasing separation distance so that transition areas (23) and (28) exhibit concave or convex curvatures or arc-shaped curvature surfaces.

Exterior housing (3) and primary valve (4) in combination form a constructed segment (29) in the upper section of exterior flow channel (11), whose flow cross section can be changed as a function of the axial position of primary valve (4). This constricted segment (29) is defined on the basis of the initial and final operational positions of primary valve (4) some distance above transition area (28) of exterior housing (3), and it ends some distance below transition area (23) of primary valve (4). In the illustrated example, the flow cross section of constricted segment (29) (between transition areas (23) and (28)), exhibits an overall flow cross section increase in the downstream direction. This is due to the fact that the diameter of transition area (28) of exterior housing (3) increases with distance from the upper end of housing (3) more than the diameter of transition area (23) increases with distance from the upper end (26) of probe (24). This result can also be achieved with arc-shaped curvature surfaces in transition areas (23) and (28).

The surface of primary valve (4) is equipped in the area of constricted segment (29) with a wear resistant jacket (30), preferably consisting of a solid tungsten carbide coating.

In the starting position (FIG. 2). primary valve (4) can rest with its lower end (31) on a shoulder (32) of support (5), however, a ring-shaped shim (33) can be provided between lower end (31) of primary valve (4) and shoulder (32) of support (5) to modify the starting position of primary valve (4). With the help of such shims, primary valve (4) can be shifted upwardly to compensate for changed flow conditions in the drilling mud composition brought about by reduced volume flow per time unit.

Figure 4:
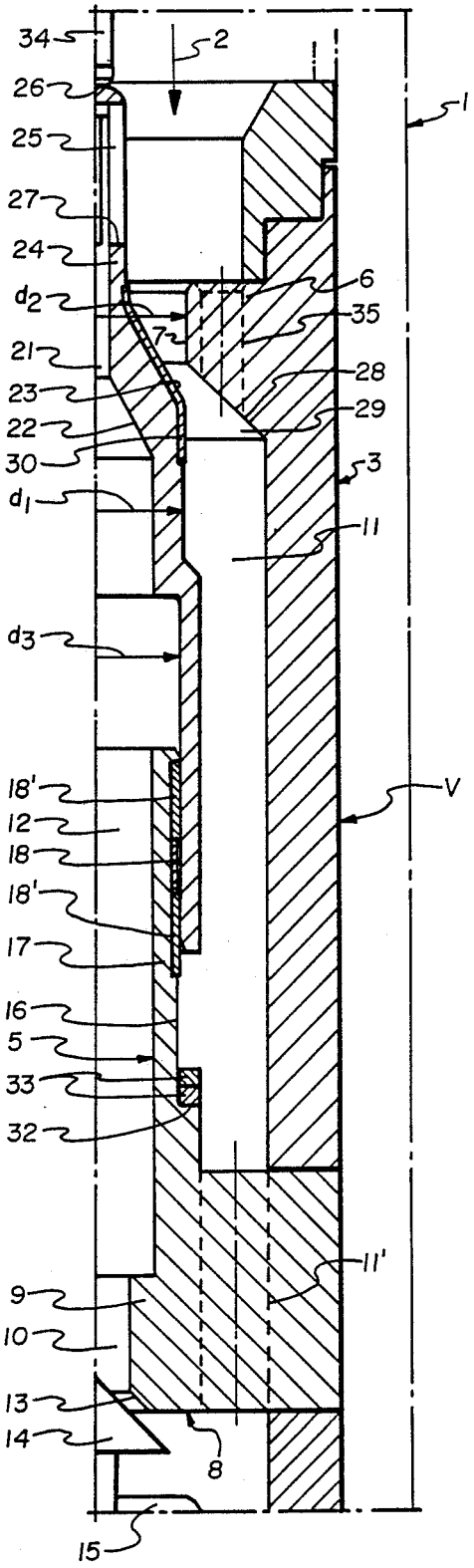
FIG. 4, a cross section similar to FIGS. 2 and 3 with the primary valve in the uppermost position after movement.

Primary valve (4) is fitted with a schematically illustrated stop (34), which provides the latter with an end-of-motion position (FIG. 4) above the operational position (FIG. 3), in which a residual flow passage for the drilling mud composition remains between primary valve (4) and exterior housing (3). However, primary valve (4) reaches this end of motion position only if drill string (1) is lowered into wellbore (B), for example in tripping into the wellbore, when there is drilling mud composition present in wellbore (B) flowing upward in interior flow channel (21), (12) and (10) of valve (V) and tending to pull primary valve (4) upward. This stop (34) can be omitted if ring section (6) contains a bypass orifice, indicated by a dotted line at 35.

To generate a pressure pulse in the drilling mud composition motor means (15) closes auxiliary valve (13) and (14) under control of apparatus (E) and thus stops the flow through interior flow channel (21), (12) and (10). The drilling mud pressure which builds in interior flow channel (21), (12) and (10) is essentially identical to the drilling mud composition pressure at the level of lower edges (27) of lateral orifices (25). The pressure loss resulting from the bleed slit (18) remains within clearly determinable limits as a result of the configuration of slit (18) as a small diameter constructed segment.

This pressure which builds up when pilot valve (13), (14) in interior flow channel (21), (12), and (10) are closed exerts upward hydraulic forces on primary valve (4), whose sum (taking into consideration interior diameter ($d_3$) of primary valve (4) which determines the hydraulically effective interior surface) exceeds the downward hydraulic forces acting on primary valve (4), plus the gravitational forces applied to the latter. This sum of the axially downward directed hydraulic forces on primary valve (4) is determined by the starting position of primary valve (4) according to FIG. 2, taking into account the exterior diameter ($d_1$) which determines the hydraulically effective exterior surface, and the sum consists of status and dynamic forces since primary valve (4) is constantly surrounded by the flow of drilling mud composition.

Immediately after closing pilot valve (13), (14), primary valve (4) consequently moves upward with an acceleration due to the difference in axial forces. This upward motion modifies the hydraulic forces which act on primary valve (4) since the upward motion results in a change in the flow cross section and the flow conditions in constricted segment (29).

In the example shown, diameters ($d_1$) and ($d_3$) are selected with respect to each other an with respect to diameter ($d_2$) so that the resultant downward force is relatively small when primary valve (4) starts to move upward after the closing of pilot valve (13), (14) from its starting position. The force then increases at first as the pulse height increases, then decreases until it equals zero. In the position at which the sum of all forces acting on primary valve (4) is zero, primary valve (4) assumes its pressure-pulse-determining final operational position shown in FIG. 3, which shows that in this position the lower edge (27) of lateral orifice (25) is located upstream from flow orifice (7) of the exterior housing. If pilot valve (13), (14) is subsequently opened again, the force relation is again reversed, and primary valve (4) returns to its starting position, as shown in FIG. 2.

The force relationships acting on primary valve (4) during its upward and downward movement can be regulated by the selection of related diameters ($d_1$), ($d_2$) and ($d_3$), which determine the static hydraulic fundamentals, by the selection of the position of lower edge (27) of lateral flow orifices (25) to constricted area (7) of exterior housing (3), which can determine the interior pressure in primary valve (4) and its change with upward movement, and by the shaping of the transition areas (23) and (28), which affect the dynamic forces via the flow behavior in constricted segment (29). As a result of this regulation of the forces acting on it, primary valve (4) approaches its two primary positions, the starting position and the operational final position, relatively slowly and leaves them relatively slowly, while in the intermediate area, the valve undergoes relatively rapid upward and downward motions. This feature is desirable to avoid excess swing of the primary valve beyond the operational final position, to eliminate as much as possible percussive effects during the upward movement and to allow short pressure pulse generation times.

What is claimed is:

1. Apparatus for generating pressure pulses in a fluid flowing within a drill string, comprising:
   - tubular housing means adapted to be secured within said drill string and defining a flow orifice on the interior thereof;
   - longitudinally reciprocable primary valve means disposed within said housing means in generally coaxial relationship thereto;
   - fluid force responsive drive means for selectively moving said primary valve means into said flow orifice to generate a pressure pulse;
   - fluid force responsive impedance means for directly longitudinally resisting said primary valve means movement into said flow orifice and preventing impact on said housing means responsive to said movement during pressure pulse generation.

2. The apparatus of claim 1, wherein said housing means and said primary valve means define a first longitudinal flow channel, said primary valve means defines a second longitudinal flow channel, and said drive means includes means for selectively closing and opening said second flow channel to respectively activate and deactivate said drive means.

3. The apparatus of claim 2, wherein said primary valve means and said flow orifice define an area of gradually increasing cross section in said first flow channel in the direction of said flowing fluid, said cross sectional area being variable with the longitudinal position of said primary valve means in said housing.

4. The apparatus of claim 3, wherein said primary valve means includes a probe means, said probe means extending into and through said flow orifice and possessing lateral orifices communicating from said second flow channel to said flow orifice where said drive means is inactive, and to an area of said housing above said flow orifice subsequent to activation thereof.

5. Apparatus for generating pressure pulses in a fluid flowing within a drill string disposed in a wellbore, comprising:
   - a tubular housing adapted to be secured in said drill string, and including a collar on the interior thereof;
   - a longitudinally reciprocable primary valve element disposed substantially coaxially within said housing in cooperative relationship with said collar;
   - fluid force responsive drive means adapted to selectively move said primary valve element toward said collar to generate a pressure pulse; and
   - fluid force responsive impedance means adapted to directly longitudinally resist said movement of said primary valve element toward said collar and to prevent contact therewith during generation of a pressure pulse.

6. The apparatus of claim 5, wherein said housing and said primary valve element define a first longitudinal flow channel, said primary valve element defines a second longitudinal flow channel, and said drive means includes a pilot valve for selectively closing and opening said second flow channel to respectively activate and deactivate said drive means.

7. The apparatus of claim 6, wherein said collar defines a flow orifice of gradually increasing diameter in the direction of said flowing fluid, and said primary valve element includes an exterior surface adjacent said flow orifice, the diameter of which also increases in the direction of said flowing fluid, but to a lesser extent than that of said flow orifice.

8. The apparatus of claim 7, wherein said primary valve element further includes a probe thereon, said probe extending from said exterior surface into and through said collar, said probe possessing laterally extending orifices communicating with said flow orifice and said second flow channel when said drive means is inactive, and with an area of said housing above said collar and said second flow channel subsequent to activation thereof.

9. A method of generating pressure pulses in a fluid flowing within a drill string, comprising:
   - providing a collar defining a flow orifice in a housing on the interior of said drill string;
   - disposing a longitudinally reciprocable valve element in said drill string in generally coaxial relationship to said flow orifice;
   - driving said valve element toward said flow orifice to generate a said pulse;
   - preventing impact of said valve element on said collar at said flow orifice responsive to said fluid flow during generation of said pulse.

10. The method of claim 9, wherein said valve element includes interior and exterior surfaces exposed to said fluid flow, and said step of driving comprises creating a pressure differential in said fluid at said interior and exterior surfaces of said valve element.

11. The method of claim 10, wherein said step of preventing comprises resisting movement of said valve element with fluid pressure outside said valve element in the vicinity of said flow orifice and with drag from said fluid flow.

* * * * *